United States Patent [19]

Klaus

[11] Patent Number: 4,551,054

[45] Date of Patent: Nov. 5, 1985

[54] DEVICE FOR THE PARKING OF AUTOMOBILE VEHICLES

[76] Inventor: Kaspar Klaus, Dr.-Berndl-Str. 5, 8940 Memmingen, Fed. Rep. of Germany

[21] Appl. No.: 587,676

[22] Filed: Mar. 8, 1984

[30] Foreign Application Priority Data

Mar. 15, 1983 [DE] Fed. Rep. of Germany ..... 3309100

[51] Int. Cl.[4] ..... E04H 6/06

[52] U.S. Cl. ..... 414/229; 414/249

[58] Field of Search ..... 414/227, 228, 229, 242, 414/249

[56] References Cited

U.S. PATENT DOCUMENTS 3,387,722 6/1968 Fisher, Sr. et al. ..... 414/229
3,493,129 2/1970 Wohr, Sr. ..... 414/229
3,741,412 6/1973 Klaus ..... 414/229
3,924,760 12/1975 Lendi ..... 414/229
4,486,140 12/1984 Klaus ..... 414/229

FOREIGN PATENT DOCUMENTS 1375800 11/1974 United Kingdom ..... 414/227

*Primary Examiner*—Robert J. Spar
*Assistant Examiner*—Ken Muncy
*Attorney, Agent, or Firm*—Holman & Stern

[57] ABSTRACT

A device for parking automobiles comprises two interconnected superimposed platforms which may be lifted and tilted to provide ground level access to either platform and fixed rail tracks and guideways on each side of the platforms. One of the trackways is fixed and the other is connected to the platforms which themselves co-operate with a fixed guide element.

7 Claims, 2 Drawing Figures

7
8
34
13
20
19
36
41
37
1
24
2
12
40
39
16

DEVICE FOR THE PARKING OF AUTOMOBILE VEHICLES

BACKGROUND OF INVENTION

1. Field of the Invention

This invention relates to a device for parking automobile vehicles in vertical spaced relationship.

2. Description of the Prior Art

In the specification of my co-pending U.S. patent application Ser. No. 437,020, filed Oct. 27, 1982, now U.S. Pat. No. 4,486,140, there is described a device for parking automobile vehicles comprising two interconnected platforms, one disposed above the other, and means for lifting and tilting the platforms, this means comprising fixed rail trackways and guide elements, for example, rollers disposed laterally of the platforms; the trackways which are substantially rectilinear and arranged side-by-side are disposed at an acute angle between them. By virture of the features of this prior invention there is a substantial simplification in the fabrication of the parking device and it is possible to reduce the structural height so that practically all parts of the trackways and their associated devices can be accommodated in a pit when the platforms are lowered. The rectilinear trackways can be made without difficulty. Consequently, it is possible to induce in the platforms the requisite inclinational movements during the lifting. In the construction of the prior invention, to avoid any jamming phenomena the two trackways are disposed relatively closely to one another at each side of the platforms. The lever arm required for adequate guidance of the platforms during the lifting movement is thus maintained so that the guide bodies, which co-operate with the fixed trackways, have an appropriate vertical spacing. The degree of this vertical spacing is however limited if one is to avoid the trackways or the parts associated therewith having a relatively large vertical height which prevents them from being accommodated in the pit.

SUMMARY OF THE INVENTION

The object of the present invention is to modify the structure of the above mentioned prior device in such a way that, whilst retaining the advantages of the construction thereof, the operative lever arms between the co-operating guide elements are improved.

In pursuance of this object the present invention proposes that of the two co-operating trackways one only shall be fixed whilst the other rail is connected to the platforms and co-operates with a fixed guide body.

Thus, according to the invention one of the trackways at each side of the platform is lifted with the platform and the associated guide elements, for example a roller which engages in a U-form rail of the trackway is arranged at an appropriate level. When the platforms are lowered and when the movable guide bodies for the lower platform have assumed the lowered position, a very much greater spacing occurs between the two guide elements thereby providing a mmore favorable lever arm. A very good guidance of the platforms is achieved in the lowermost position. Admittedly the spacing between the guide bodies, and thus of the rollers is less during the lifting movement. At the end of the lifting movement however the effective spacing between the guide bodies is always as great as in the earlier construction, because in the end position of the platforms further supporting elements come into effect, for example the hydraulic lifting means in the end position holds the platforms additionally secure and a substantial improvement of the guidance of the movable platforms is achieved.

A further advantageous feature of the invention is that simple rollers can be used as the guide elements and these engage in the U-form trackways. These U-form trackways present a relatively simple constructional element which can readily be used for other functions, for example as supporting means and so on.

Thus the invention proposes in particular that the trackway connected to the platforms may form a means for connecting the platforms together. The trackway which is movable with the platforms may thus also fulfil the function of connecting the platforms together or support their functioning.

It is of advantage if the fixed guide body is arranged in the area of the upper end of the fixed trackway which may be upright.

BRIEF DESCRIPTION OF THE DRAWINGS

An embodiment of the invention is diagrammatically illustrated in the drawings wherein.

DETAILED DESCRIPTION OF THE PREFERRED EMBODIMENT

Figure 1:
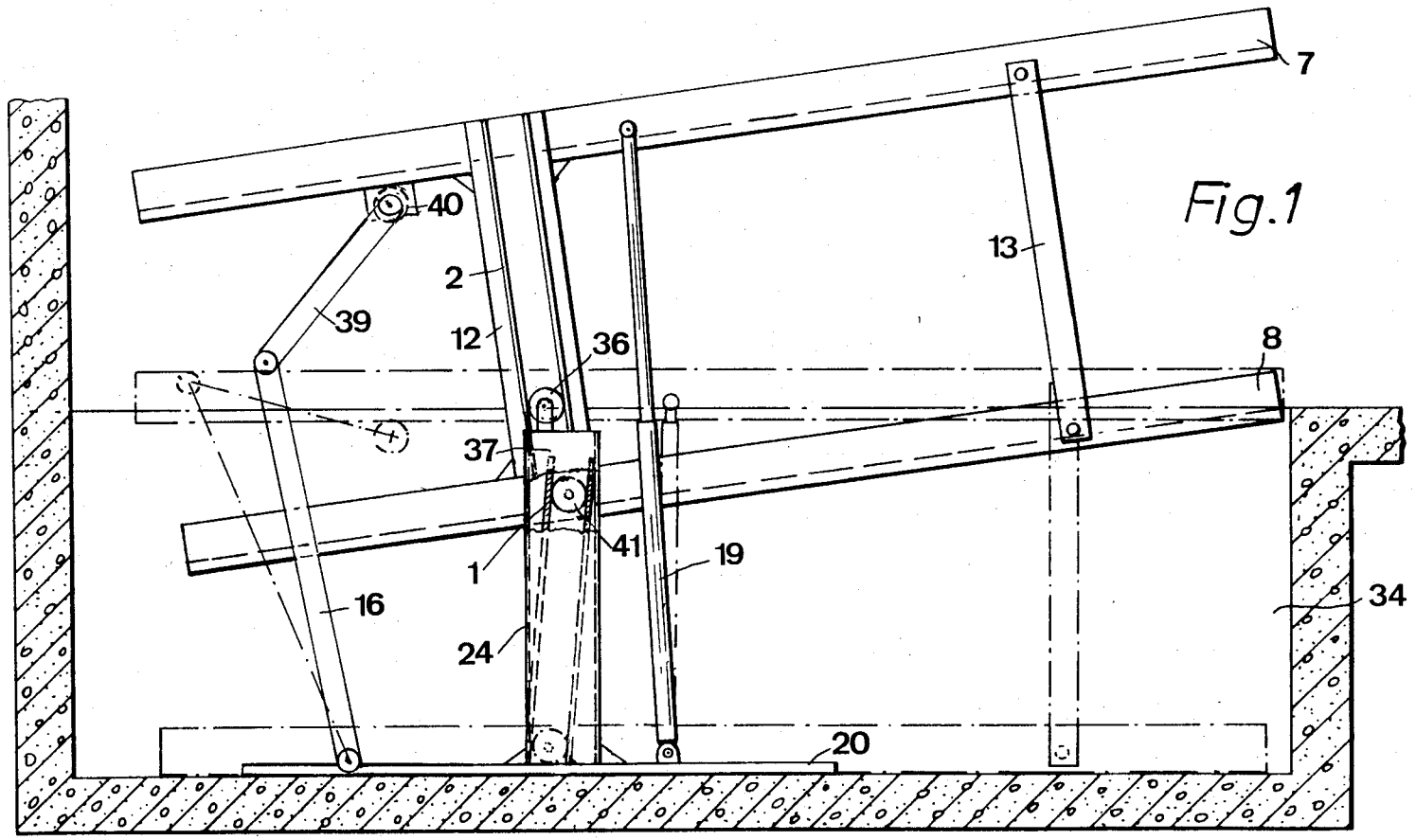
FIG. 1 is a side elevational view partly in cross section of a parking device in accordance with the present invention.
Figure 2:
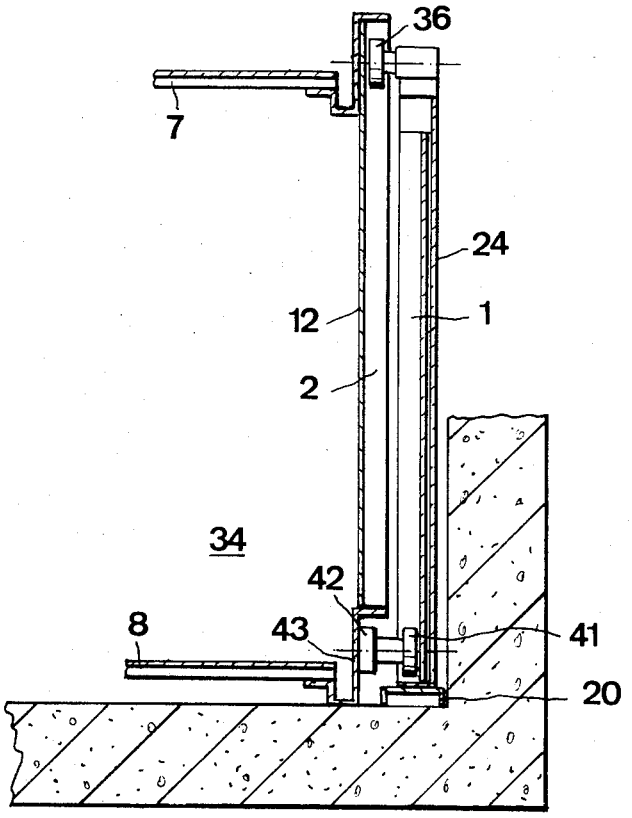
FIG. 2 is a partial cross-section on an enlarged scale through the device of FIG. 1.

Mounted in the pit 34 is the base frame 20 which supports a lifting cylinder 19, such as a hydraulic lifting cylinder for example, and in addition the bearers 24. Also mounted on the base frame 20 is a link 16. This link 16 co-operates with a further link 39 and the two links 16 and 39 form an assembly which is disposed at both sides of the platforms 7 and 8 and are connected by a torsion-resistant shaft 40 which is mounted on the upper platform 7. This provides for a rectilinear guidance for the platforms.

The bearer 24 holds the fixed trackway 1 which is inclined to the vertical to a predetermined extent. The fixed trackway 1 is constituted by a U-profile iron which is open towards the platforms 7 and 8. This U-iron engages the roller 41 which serves as the guide element and is secured by means of the part 42 to the longitudinal section 43 of the lower platform 8.

Mounted at the upper end of the bearer 24, that is to say in the region of the upper end 37 of the trackway 1, is the fixed roller 36 which cooperates as a guide element with the trackway 2.

In the embodiment illustrated the trackway 2 is mounted on a strut 12 which connects the two platforms 7 and 8 together. It is also possible however to dispense entirely with the strut 12 and in this area to provide a connection between the platforms 7 and 8 by means of the trackway 2 only. The other connecting strut is indicated at 13. The trackway 2 is formed by an outwardly open U-profile iron having the roller 36 engaged therein.

In the lowered condition of the platforms which is indicated in FIG. 1 with dotted lines, the spacing between the two rollers 41 and 36 is of comparably large size. In the lifted condition, which is indicated by full lines in FIG. 1, this spacing is certainly less but is still wholly adequate. An additional stabilization of the lifted position can be obtained, if required, by the design of the ends of the trackways 1 or 2 in placing the guide elements close to these, when raised under the influence of the lifting cylinder.

In the operation of the device, with the platform lowered as shown in phantom in FIG. 1 the lifing cylinder 19 is activated to raise the platform whereby rollers 41 roll upwardly along fixed trackway 1 and movable trackway 2 moves upwardly guided by fixed roller 36 engaging within it. Since trackway 1 is slightly inclined to the vertical, as roller 41 moves upwardly, its axis of rotation gradually shifts to the right as viewed in FIG. 1 with respect to roller 36 thereby causing platform 8 to shift to the right which tilts the entire platform assembly counterclockwise about fixed roller 36. Thus roller 36 functions not only as a guide element but also as a pivot element. During lowering the operation is reversed and inclined trackway 1 causes the platform assembly to gradually tilt clockwise until it reaches the fully lowered position.

The parking device according to the invention may be modified in various ways. For example the fixed trackway 1 may be replaced by appropriately dimensioning the bearers 24, and also the manner of constructing the fixed trackway may be modified as is described by way of example in my co-pending application.

What we claim is:

1. A device for parking automobile vehicles comprising:

an upper and a lower platform;

means to support said platforms in vertical spaced relationship;

means to raise and lower both of said platforms between a lower, horizontal position and an upper, tilted position;

a pair of substantially rectilinear coordinated trackways disposed laterally at each side of said platforms and extending substantially alongside each other when said platforms are in a lowered position to define an acute angle therebetween when viewed from the side, said pair of trackways on each side of the platform extend beneath said upper platform in both the raised and lowered positions;

a first one of each pair of coordinated trackways being fixed;

a second one of each pair of coordinated trackways being connected to said platforms and movable therewith; and guide elements cooperatively engaging said trackways;

one of said guide elements being a fixed guide element cooperatively engaging each second trackway.

2. A parking device as claimed in claim 1, wherein said guide elements are in the form of rollers.

3. A parking device as claimed in claim 1, wherein said second one of each pair of trackways connected to the platforms comprises means to couple the platforms together.

4. A parking device as claimed in claim 1, wherein each fixed trackway is disposed upright and has an upper end and a fixed guide element is disposed in the area of said upper end of each fixed trackway.

5. A parking device as claimed in claim 4 wherein, each fixed guide element is positioned relative to the respective fixed trackway so that as said platforms are raised each second trackway and said platforms are gradually tilted with respect to their lowered positions.

6. A parking device as claimed in claim 5 further comprising a base frame, and wherein, each fixed trackway is supported on said base frame, and said means to raise and lower said platforms comprises hydraulic lifting cylinder means pivotally connected to one of said platforms and to said base frame in a relative position with respect to said trackways and guide elements to support said platforms in a raised position.

7. A parking device as claimed in claim 6 wherein said lifting cylinder is pivotally connected to said upper platform.

* * * * *